United States Patent [19]

Chou et al.

[11] Patent Number: 4,712,252

[45] Date of Patent: Dec. 15, 1987

[54] ANTI-WIND RAINCOATS

[76] Inventors: Hsii C. Chou, 181, Guang Hwa 1 Rd., Kaohsiung, Taiwan, 800; Jeef Wu, 2F, No. 9-1, Lane 80, Guang Fu 1 St.; John Chang, 19, Alley 24, Lane 29, Chung Hwa 1 Rd., both of Kaohsiung, Taiwan

[21] Appl. No.: 41,116

[22] Filed: Apr. 22, 1987

[51] Int. Cl.[4] ..... A47B 3/04

[52] U.S. Cl. ..... 2/87

[58] Field of Search ..... 2/85, 86, 87, 108, 93, 2/211, 212, 213, 69.5

[56] References Cited

U.S. PATENT DOCUMENTS

| | | | |
|---|---|---|---|
| 1,368,835 | 2/1921 | Place | 2/87 |
| 2,321,116 | 6/1943 | Welch | 2/87 |
| 2,791,776 | 5/1957 | Kampherbeek | 2/87 |

*Primary Examiner*—Doris L. Troutman

*Attorney, Agent, or Firm*—Holman & Stern

[57] ABSTRACT

This invention is made up of three parts, a coat, sleeves and a skirt. The sleeves have two sticker fastenings around them able to stick together to keep the sleeves stable when folded up short. The skirt is rolled up and hidden at the lowest part of the coat with a horizontally set zipper when it is not needed and can be rolled down with the zipper opened and fastened together at its front with sticker fastenings if necessary.

1 Claim, 3 Drawing Figures

ANTI-WIND RAINCOATS

BACKGROUND OF THE INVENTION

A raincoat is indispensable in montaineering. A conventional raincoat used by mountain climbers is mostly a kind of windcoat, which can protect a person from wind, with a broad collar which can be pulled up to make up a head cover in case of rain for protecting his upper body and head from rain. Nevertheless, his lower body, or his legs and feet, cannot be covered by the windcoat, so he will become half wet and feel uncomfortable, or maybe grow sick. Besides, the windcoat generally has long sleeves which have to be folded up short because of sultry feeling caused by a long laborious climbing up a mountain.

SUMMARY OF THE INVENTION

In view of the shortcomings of a conventional raincoat for mountaineering mentioned above, the inventor has worked out this anti-wind raincoat.

This invention, an anti-wind raincoat, consists of a coat, long sleeves and a skirt. The long sleeves can be pulled and folded up short by means of sticker fastenings and a skirt can be rolled up connected and hidden at the lowest part of the coat with a zipper in case of fine weather, and rolled down in case of rain.

DETAILED DESCRIPTION OF THE INVENTION

Figure 1:
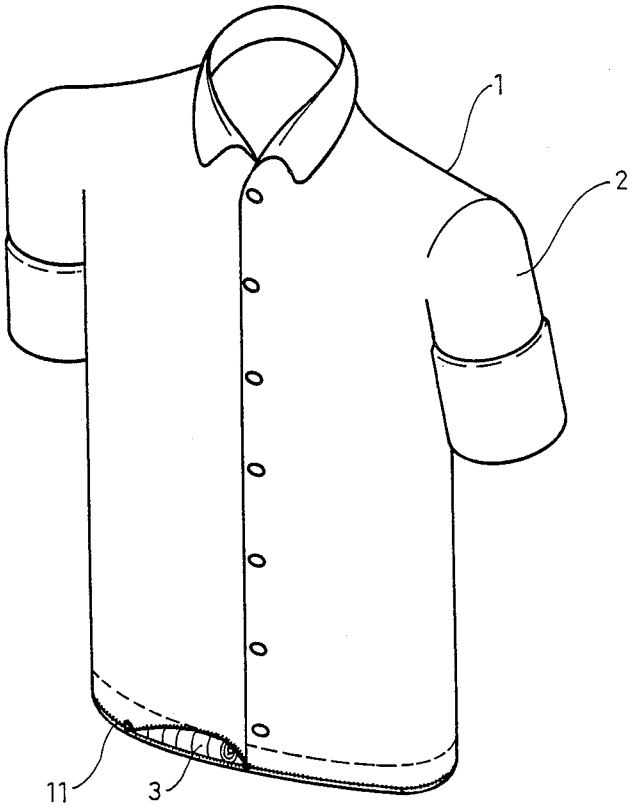
FIG. 1 is a view of the anti-wind raincoat with its sleeves folded up short and its skirt rolled up and hidden in the lowest part of the coat in this invention.

As FIG. 1 shows, this anti-wind raincoat consists of coat 1, sleeves 2 and skirt 3, made of material able to endure wind and rain.

Zipper 11 is set horizontally around the lowest part of coat 1, and when zipper 11 is pulled open skirt 3 rolled up hidden inside generally can be rolled down because of the softness and flexibility of the material.

Figure 2:
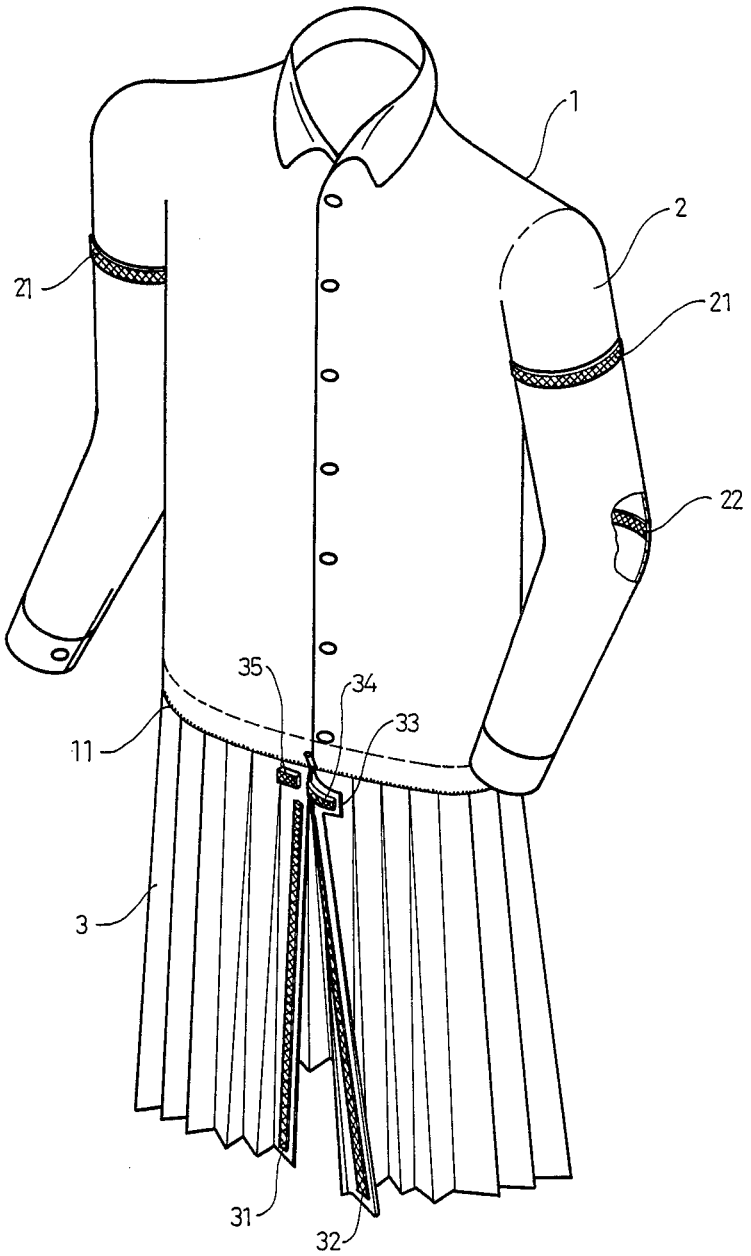
FIG. 2 is a structural view of the anti-wind raincoat in this invention.

FIG. 2 shows sleeves 2, which have sticker fastenings 21 set around its upper parts near the shoulders and also sticker fastenings 22 set inside around near the elbows. Then sleeves 2 can be folded up short and kept stable by fastening sticker fastening 21 with sticker fastening 22 together, if necessary.

Figure 3:
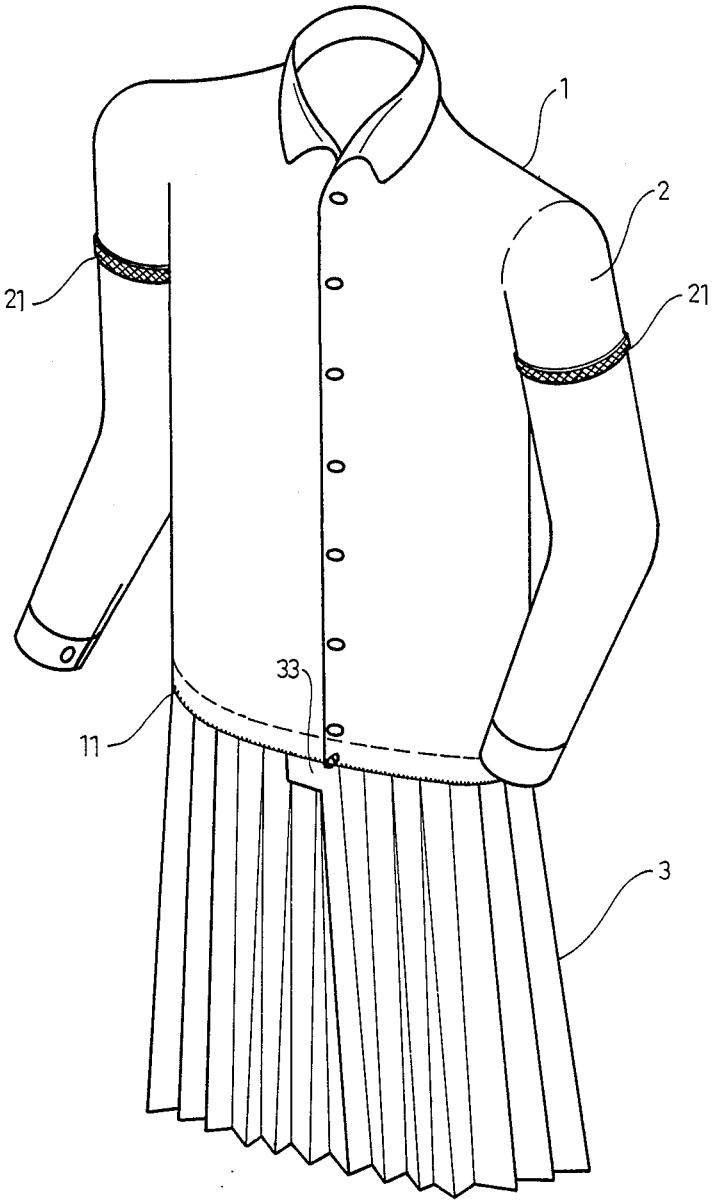
FIG. 3 is an outward view of the anti-wind raincoat in use in this invention.

Skirt 2 shown in FIGS. 2, 3 is made up as a kind of pleated skirt with sticker fastenings 31, 32 set vertically at the left and right sides of its front center and able to be fastened together; besides there is flap 33 at the uppermost front center and inside of flap 33 and on the part covered by flap 33 are set sticker fastenings 34, 35, which are to be fastened together to prevent rain from dropping in.

This anti-wind raincoat has been designed to be useful not only as a windcoat in fine weather but also as a raincoat in wet weather with its pleated skirt rolled down and sleeves folded down without interfering with walking at all. And the special feature of its material enables the skirt and sleeves quite simple and quick to be tucked away when they become unnecessary.

What is claimed is:

1. A kind of anti-wind raincoat comprising, a coat made of cloth that can prevent wind or rain from blowing through or wetting, and having two sleeves at the shoulders, and a horizontal zipper at the lowest part for hiding a skirt able to be rolled up inside or rolled down when the zipper has been pulled open, sleeves having separately a ring of sticker fastening around its upper part and around inside near elbows which can stick together when the sleeves are folded up short, a skirt made up as a kind of pleated skirt extending down from the lowest part of the coat, having a vertical opening at its front; one side and the other side of the opening are verticaally set with a sticker fastening separately inside and outside which can be stick together, and having the characteristics that in fine weather the skirt can be rolled up and hidden in the lowest part of the coat by means of the horizontal zipper set around the coat, and the sleeves can be folded up short kept steady by sticking together the sticker fastenings, and that in wet weather the skirt can be rolled down by pulling open the zipper and stuck together by the sticker fastenings and the sleeves can also be folded down long by releasing the sticker fastenings.

* * * * *